US010434633B2

(12) United States Patent
Gravina

(10) Patent No.: US 10,434,633 B2
(45) Date of Patent: Oct. 8, 2019

(54) MAGNETIC DISC FOR DRILL

(71) Applicant: Andrew Gravina, Dumont, NJ (US)

(72) Inventor: Andrew Gravina, Dumont, NJ (US)

( * ) Notice: Subject to any disclaimer, the term of this patent is extended or adjusted under 35 U.S.C. 154(b) by 0 days.

(21) Appl. No.: 15/264,715

(22) Filed: Sep. 14, 2016

(65) Prior Publication Data

US 2018/0071900 A1 Mar. 15, 2018

(51) Int. Cl.
*B25B 23/12* (2006.01)

(52) U.S. Cl.
CPC ..... *B25B 23/12* (2013.01)

(58) Field of Classification Search
CPC ..... B25B 23/12; B25B 23/08; B25B 23/02; B25B 11/002; B25B 15/00; B25F 5/029; B25F 5/02
USPC .... 81/177.4, 180.1, 184, 490; 206/350, 379; 224/183; 211/69
See application file for complete search history.

(56) References Cited

U.S. PATENT DOCUMENTS 2,806,706 A * 9/1957 Fitch ..... B25B 23/0035 200/83 P
5,196,818 A * 3/1993 Anderson ..... A45F 5/00 223/109 A
5,259,278 A * 11/1993 Leas ..... B25B 23/12 81/125
5,799,552 A * 9/1998 Curtis ..... B25B 15/02 81/177.4
5,913,596 A * 6/1999 Lin ..... B25B 15/02 362/109
5,916,341 A * 6/1999 Lin ..... B25B 15/02 81/177.4
6,496,094 B2 * 12/2002 May, III ..... B25B 11/002 211/69
7,107,882 B1 * 9/2006 Chang ..... B25B 15/02 81/125
9,789,590 B2 * 10/2017 Macias ..... B25B 11/002
2003/0079580 A1 * 5/2003 Beauchamp ..... B25F 5/029 81/490
2017/0074308 A1 * 3/2017 Tseng ..... B25B 23/0035
2017/0120427 A1 * 5/2017 Tsai ..... B25B 15/02

* cited by examiner

*Primary Examiner* — Hadi Shakeri
(74) *Attorney, Agent, or Firm* — Michael J. Feigin, Esq.; Feigin & Fridman LLC.

(57) ABSTRACT

A disc for holding small parts to a drill, screwdriver, or other tool is disclosed. The tool has a rotating shaft, which it uses to function and the disc sits on this shaft stationary, while the shaft rotates, or, at least, rotates at a much lesser rate. The disc is also magnetic, so small parts, such as screws and other fasteners, as well as bits (e.g. drill bits and screwdriver heads) made of metal attach to the circular disc by way of magnetic force. In this manner, one can use the tool causing the shaft to rotate while holding the small parts to the circular disc situated on the shaft.

14 Claims, 4 Drawing Sheets

MAGNETIC DISC FOR DRILL

FIELD OF THE DISCLOSED TECHNOLOGY

The disclosed technology relates generally to drilling accessories and, more specifically, to a disc for magnetically attaching fasteners while drilling.

BACKGROUND OF THE DISCLOSED TECHNOLOGY

"Where did I leave my screws?" and "Oh no, the nail rolled off the table!" are frequent thoughts running through the heads of people who are using electric tools. Fastening mechanisms such as screws and nails and other small metallic elements, including drill bits and screw driver heads, are easy to misplace. One has to operate the electric tool, or even a mechanical tool (such as a manual screwdriver) with typically one working end attachment at a time. This working end attachment (defined herein as "a removable or non-removable end which rotates in order to cause another device to also rotate or for a hole to be formed therein"). One then acts upon another object, such as a fastener, screwdriver head, or another material to fasten, cut, rotate, create a hole, or the like. Meanwhile, the other fasteners, bits, screwdriver heads, socket wrench heads, and those devices which are capable of being magnetized and having a longest length less than 10 centimeters (cm), 8 cm, or 5 cm (herein collectively referred to as, and defined as, "small parts") must be kept somewhere where they are not liable to be lost.

This is a known problem in the art. Some, such as Otho D. May, III, in his U.S. Pat. No. 6,496,094, have tried to solve this problem. In this patent Mr. May discloses a clamp which attaches around the body of a drill having a magnet on top to hold screws while drilling. Daniel Wallace Baird, in U.S. Pat. No. 5,842,584 acts similarly with a clamp around the outside having portals for larger items, such as pencils.

What is needed is a way to hold the smaller items to a drill which is easy to use and places small parts which one plans to use in connection with use of the tool in easy reach, so that one does not need to look away from his work or move the tool away. This would increase efficiency and decrease aggravation.

SUMMARY OF THE DISCLOSED TECHNOLOGY

A disc for holding small parts to a drill, screwdriver, or other tool is disclosed. The tool has a rotating shaft which it uses to function and, the disc sits on this shaft stationary while the shaft rotates, or at least, rotates at a much lesser rate. The disc is also magnetic, so small parts, such as screws and other fasteners as well as bits (e.g., drill bits and screwdriver heads) made of metal attach to the circular disc by way of magnetic force. In this manner, one can use the tool causing the shaft to rotate, while holding the small parts to the circular disc situated on the shaft.

A magnetic small part holding system of embodiments of the disclosed technology has a tool with an elongated shaft which rotates during a primary use of the tool. "Primary use" is defined as one of the intended uses by a manufacturer of the tool. Thus, a primary use of a drill or screwdriver is typically to make a hole or spin a fastener into a hole. Typically, an elongated shaft (or an "attachment mechanism" or "working end attachment," (as described in the detailed description) rotates as a result of the tool being used for it's primary purpose. A circular disc with magnet is also used with at least some equally sized sectors of the circular disc being of equal size and weight. The elongated shaft passes through a portal of the circular disc.

The portal has a smooth interior, in embodiments of the disclosed technology. In some embodiments, the elongated shaft has a first section with a circumference larger than a circumference of the portal, and a second section with a circumference smaller than the circumference of the portal. In such an embodiment, the circular disc can be situated between a) a frictional attachment mechanism of the tool (which frictionally holds the elongated shaft) and b) the first section of the elongated shaft having the larger circumference.

All sectors of a first and second circular side (top and bottom sides) of the circular disc are of equal size and weight, in some embodiments. A plurality of small parts is magnetically held to the circular disc at the top or bottom side. In use, the elongated shaft can be rotating, while the circular disc is stationary relative to the ground.

A method of using the magnetic small part holding system, in embodiments of the disclosed technology, includes grasping the tool, placing the circular disc around the elongated shaft, connecting the elongated shaft into a frictional attachment mechanism of the tool, and rotating at least the elongated shaft of the tool while using a business end of the tool. A step of magnetically attaching small parts to the circular disc before the step of rotating can also be carried out.

Another way of describing embodiments of the small part holding kit is as a circular disc with central portal, at least one magnet within the circular disc which is evenly weighted around the disc, and an elongated shaft extending through the central portal which is adapted to be, or is, held by a tool. The tool functions by way of rotation of the elongated shaft. At least one fastener can be magnetically held to the circular disc. The elongated shaft can have a first end with circumference greater than that of the central portal, and a second end with circumference less than that of the central portal. The shaft, in embodiments, rotates when the tool functions by way of rotation, while the circular disc remains stationary. An interior side of the portal which abuts the elongated shaft is smooth, in embodiments of the disclosed technology.

Any device or step to a method described in this disclosure can comprise, or consist of, that which it is a part of, or the parts which make up the device or step. The term "and/or" is inclusive of the items which it joins linguistically, and each item by itself.

DETAILED DESCRIPTION OF EMBODIMENTS OF THE DISCLOSED TECHNOLOGY

A disc for holding small parts to a drill, screwdriver, or other tool is disclosed. The tool has a rotating shaft which it uses to function and the disc sits on this shaft stationary while the shaft rotates, or at least, rotating at a much lesser rate. The disc is also magnetic so small parts, such as screws and other fasteners as well as bits (e.g., drill bits and screwdriver heads) made of metal attach to the circular disc by way of magnetic force. In this manner, one can use the tool causing the shaft to rotate, while holding the small parts to the circular disc situated on the shaft.

Embodiments of the disclosed technology are described below, with reference to the figures provided.

Figure 1:
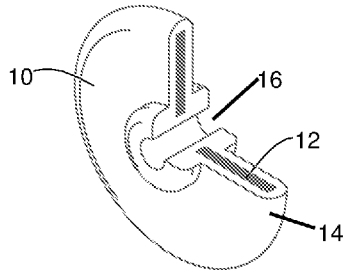
FIG. 1 shows a cutaway view of a magnetic disc used in embodiments of the disclosed technology.

FIG. 1 shows a cutaway view of a magnetic disc used in embodiments of the disclosed technology. The magnetic disc 10 has an outer shell 14 formed of a resilient solid, through which magnetic force can pass, such as a plastic or polymer. A magnet 12 is held within the shell 14, though in other embodiments the magnet can be partially or fully exposed to the outside. A portal 16 passes through the center region of the disc, sized to fit around a working end attachment, such as the working end attachment 30 shown in FIG. 2. The portal 16, in some embodiments, has a smooth interior surface, allowing the disc to remain in place or move at a substantially slower rotation on the order of 100 or more, while a working end attachment spins there-in.

Figure 2:
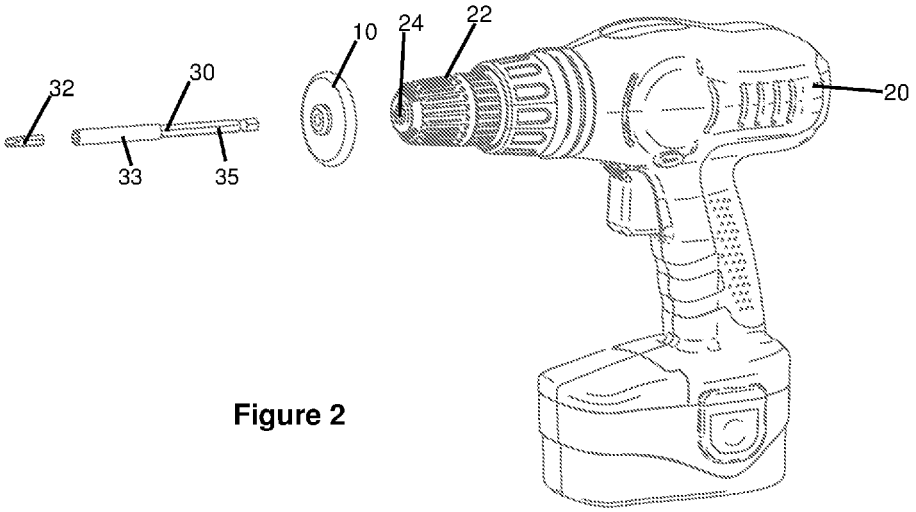
FIG. 2 shows a tool and parts used with the magnetic disc, in embodiments of the disclosed technology.

FIG. 2 shows a tool and parts used with the magnetic disc, in embodiments of the disclosed technology. Here, a tool 20 is an electric tool (e.g., electric drill) or manual tool (e.g., manual screwdriver). In the embodiment shown in FIG. 2, the tool 20 is an electric tool, which has a rotating business end 22 and attachment mechanism 24, used to frictionally hold a working end attachment, such as working end attachment 30. In this case, the working end attachment 30 is an elongated shaft, with male and female ends oppositely disposed. A small part 32 (see definition in the 'background') attaches to the working end attachment 30.

Figure 3:
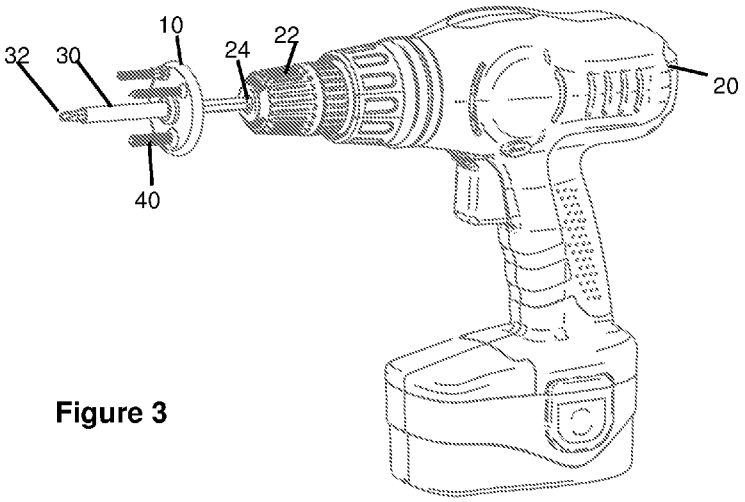
FIG. 3 shows small parts attached to the magnetic disc situated on a working end attachment, in an embodiment of the disclosed technology.

FIG. 3 shows small parts attached to the magnetic disc situated on a working end attachment, in an embodiment of the disclosed technology. Here, a first small part 32 (screwdriver head) is inserted and frictionally and/or magnetically held with the attachment mechanism 30. A second set of small parts 40 (screws) are magnetically held to the magnetic disc 10. The attachment mechanism 30 passes through the portal 16 of the magnetic disc 10. The attachment mechanism can have a portion thereof with a larger circumference and a portion thereof with a smaller circumference. The portion with the larger circumference 33 has a circumference larger than the portal 16 of magnetic disc 10 such that the magnetic disc cannot slide there-over and fly off while being used. The smaller circumference 35 is of equal or smaller circumference than the portal 16 of the magnetic disc 10. It should be understood that the term "circumference" is a mathematical term known in the art and refers to the circumference of a circle—that is, the distance around the perimeter of a circle. Other terminology such as diameter, radius, and so forth, can similarly be determined for the circles shown, using well known mathematical principles.

Thus, one uses the device by placing the magnetic disc 10 around an attachment mechanism 30 such as by placing the attachment mechanism 30 through the portal 16 of the disc 10. Then one attaches the attachment mechanism to a business end 22 of a tool 20 and fastens it there-to, such with a friction to a frictional attachment mechanism 24. One then attaches a small tool, such as a fastener 40, the disc where it is held by magnetic force. When using the tool to rotate a shaft, such as the shaft of an attachment mechanism 30, such a shaft rotated within a stationary or more slowly moving magnetic disc 10.

Figure 4:
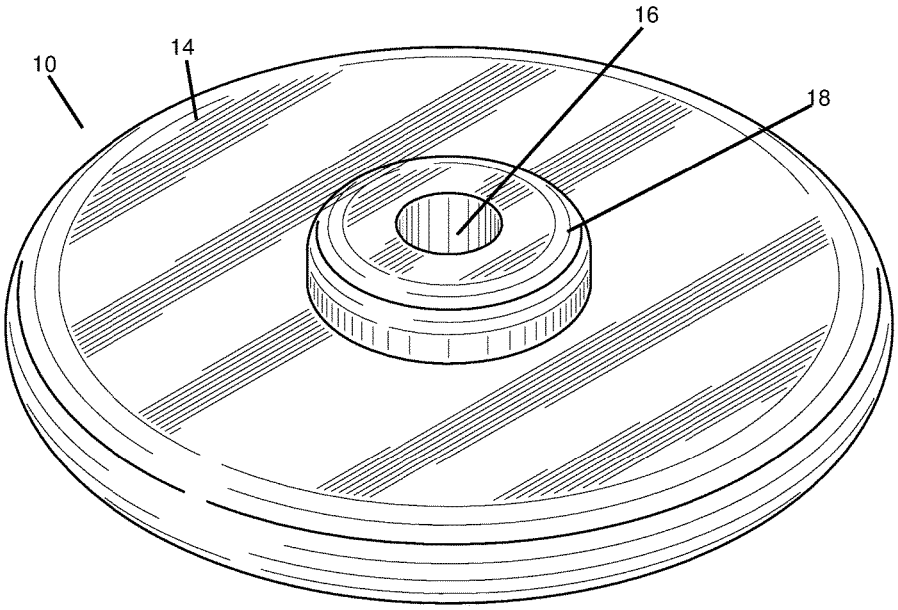
FIG. 4 shows a top perspective view of a magnetic disc used in embodiments of the disclosed technology.
Figure 5:
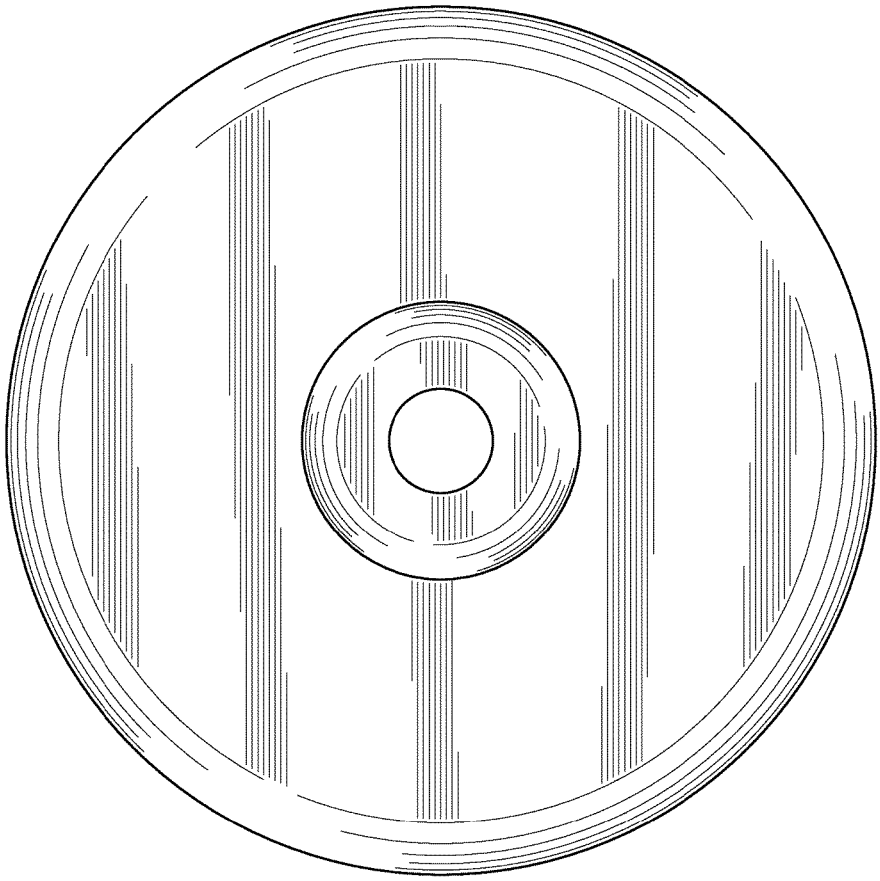
FIG. 5 shows a top plan view of the magnetic disc of FIG. 4.
Figure 6:
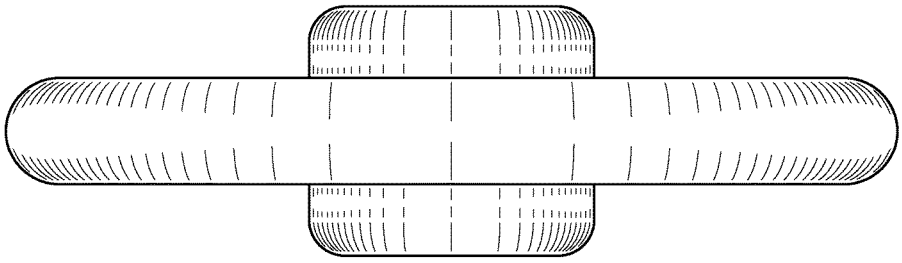
FIG. 6 shows a side view of the magnetic disc of FIGS. 4 and 5.

FIGS. 4, 5, and 6 show further views of the magnetic disc 10. FIG. 4 shows a top perspective view of a magnetic disc used in embodiments of the disclosed technology. FIG. 5 shows a top plan view of the magnetic disc of FIG. 4. FIG. 6 shows a side view of the magnetic disc of FIGS. 4 and 5. The magnetic disc 10 has an outer shell 14 and inner rim 18 rising about the plane of the outer shell, in some embodiments of the disclosed technology. A portal 16 passes there-through. The magnetic disc 10 is weighted and sized equally in all radial directions. Thus, any two equally-sized sectors (using the mathematical definition of a sector of a circle) are of equal size and weight (defined as "within an acceptable tolerance level known in the industry, such as within 1%, 0.1%, or 0.01%").

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. A magnetic small part holding system comprising:

a tool including a grasping portion and an elongated shaft which rotates during a primary use of said tool, said elongated shaft terminating in a working end; and a circular disc including a hollow annular housing portion defining a central portal at a center of said circular disc and an annular magnet, said circular disc being devoid of portals other than said central portal and having first and second flat exterior surfaces devoid of portals, said annular magnet is disposed within said hollow annular housing portion in a radial direction, wherein at least some equally-sized sectors of said circular disc are of equal size and weight, wherein said elongated shaft passes through said portal, such that said annular magnet surrounds said elongated shaft from all sides thereof, and a surface of said hollow annular housing portion is disposed between said magnet and said elongated shaft in a radial direction, wherein a radius of said hollow annular housing portion and a diameter of said circular disc are both greater than a longitudinal length of said portal and than a longitudinal length of said hollow annular housing portion, each of a plurality of small parts is magnetically held to one of said first and second flat exterior surface of said hollow annular housing portion, and are separated from said annular magnet by said hollow annular housing portion, without engaging said elongated shaft or said working end, and wherein, during rotation of said elongated shaft, said circular remains stationary relative to the ground or rotates at a rate 100 or more times slower than said elongated shaft.

2. The magnetic small part holding system of claim 1, wherein said portal has a smooth interior.

3. The magnetic small part holding system of claim 2, wherein said elongated shaft has a first section with a circumference larger than a circumference of said portal and a second section with a circumference smaller than said circumference of said portal, said first section being adjacent said working end of said shaft, and said second section being disposed between said grasping portion and said first section.

4. The magnetic small part holding system of claim 3, wherein said circular disc is situated between a) a frictional attachment mechanism of said tool which frictionally holds said elongated shaft to said grasping portion, and b) said first section of said elongated shaft having said larger circumference.

5. The magnetic small part holding system of claim 4, wherein all sectors of a first and second circular side of said circular disc are of equal size and weight.

6. The magnetic small part holding system of claim 1, wherein said plurality of small parts are held to said circular disc while said working end engages a specific small part, said specific small part not being one of said plurality of small parts.

7. The magnetic small part holding system of claim 1, wherein said plurality of small parts are simultaneously magnetically held to said circular disc.

8. A method of using said magnetic small part holding system of claim 1, comprising the steps of:

grasping said grasping portion of said tool;

placing said circular disc around said elongated shaft;

connecting said elongated shaft into a frictional attachment mechanism of said tool;

rotating at least said elongated shaft of said tool while using said working end of said tool.

9. The method of claim 8, further comprising a step of magnetically attaching each of said plurality of small parts to at least one of said first and second flat exterior surfaces of said circular disc without said small parts engaging said shaft.

10. A small part holding kit comprising:

a circular disc including a hollow annular housing, said hollow annular housing defining a central portal and first and second flat exterior surfaces, and being devoid of portals other than said central portal;

at least one magnet within said circular disc which is evenly weighted around said disc, said at least one magnet being disposed within said annular housing of said circular disc in a radial direction;

an elongated shaft extending through said central portal such that said at least one magnet surrounds said elongated shaft from all sides thereof, and a surface of said annular housing is disposed between said at least one magnet and said elongated shaft in a radial direction, said elongated shaft adapted to be, or is, held by a tool, said tool functioning by way of rotation of said elongated shaft; and at least one fastener magnetically held to one of said first and second flat exterior surfaces of said annular housing without engaging said elongated shaft, such that said annular housing is disposed between said at least one fastener and said at least one magnet, wherein a radius of said annular housing portion and a diameter of said circular disc are both greater than a longitudinal length of said central portal and than a longitudinal length of said annular housing portion, and wherein, during rotation of said elongated shaft, said circular remains stationary relative to the ground or rotates at a rate 100 or more times slower than said elongated shaft.

11. The small part holding kit of claim 10, wherein said elongated shaft comprises a first end with circumference greater than that of said central portal and a second end with circumference less than that of said central portal, said second end being disposed between said tool and said first end.

12. The small part holding kit of claim 10, wherein an interior side of said portal which abuts said elongated shaft is smooth.

13. The small part holding kit of claim 10, wherein said at least one fastener comprises a plurality of fasteners simultaneously magnetically held to an exterior surface of said annular housing of said circular disc, such that said housing is disposed between each of said plurality of fasteners and said at least one magnet.

14. The small part holding kit of claim 13, wherein said plurality of small parts are held to said circular disc while a working end of said elongated shaft engages a specific small part, said specific small part not being one of said plurality of small parts.

* * * * *